US010154558B1

(12) United States Patent
Zhang

(10) Patent No.: US 10,154,558 B1
(45) Date of Patent: Dec. 11, 2018

(54) PARALLEL CONNECTABLE LIGHT CONTROL SYSTEM

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 16/036,166

(22) Filed: Jul. 16, 2018

Related U.S. Application Data

(60) Provisional application No. 62/533,260, filed on Jul. 17, 2017.

(51) Int. Cl.

| | |
|---|---|
| ***H05B 37/02*** | (2006.01) |
| ***H05B 33/08*** | (2006.01) |
| ***F21K 9/278*** | (2016.01) |
| ***F21V 23/06*** | (2006.01) |

(52) U.S. Cl.
CPC ..... *H05B 33/0848* (2013.01); *F21K 9/278* (2016.08); *F21V 23/06* (2013.01); *H05B 33/0827* (2013.01)

(58) Field of Classification Search
CPC . H05B 33/0848; H05B 33/0827; F21K 9/278; F21V 23/06
USPC ..... 315/307
See application file for complete search history.

(56) References Cited

U.S. PATENT DOCUMENTS

| | | | | |
|---|---|---|---|---|
| 9,644,828 | B1 * | 5/2017 | May | F21V 7/00 |
| 9,719,642 | B1 * | 8/2017 | Macias | F21S 10/02 |
| 2010/0060175 | A1 * | 3/2010 | Lethellier | H05B 33/0815 315/164 |
| 2012/0320627 | A1 * | 12/2012 | Araki | F21S 8/04 362/608 |
| 2013/0211608 | A1 * | 8/2013 | Farrell | G06F 1/26 700/286 |
| 2013/0215614 | A1 * | 8/2013 | Gulden | F21V 21/00 362/249.02 |
| 2014/0001959 | A1 * | 1/2014 | Motley | H05B 37/02 315/149 |
| 2014/0070710 | A1 * | 3/2014 | Harris | H05B 33/0809 315/185 R |
| 2014/0232289 | A1 * | 8/2014 | Brandes | H05B 33/083 315/250 |
| 2015/0115809 | A1 * | 4/2015 | Siessegger | H05B 33/0803 315/185 R |
| 2015/0115823 | A1 * | 4/2015 | Serra | H05B 33/0827 315/201 |
| 2016/0212815 | A1 * | 7/2016 | Watanabe | H05B 33/0845 |
| 2017/0311398 | A1 * | 10/2017 | Jiang | F21V 19/003 |

* cited by examiner

*Primary Examiner* — Don Le
(74) *Attorney, Agent, or Firm* — Clement Cheng

(57) ABSTRACT

A parallel connectable light control system has a first driver and a second driver. A dimming control interface in the first driver. The dimming control interface has a sensor side signal and the dimming signal internal output. The dimming signal internal output outputs to a dimming signal external output. The sensor side signal outputs to a sensor side signal output. The second driver receives the dimming signal external output into a dimming control interface of the second driver.

10 Claims, 2 Drawing Sheets

PARALLEL CONNECTABLE LIGHT CONTROL SYSTEM

This application is a non-provisional of and claims priority from provisional United States parent patent application 62/533,260 by same inventor Kanghong Zhang, also entitled Parallel Connectable Light Control System filed Jul. 17, 2017, the disclosure which is incorporated herein by reference.

FIELD OF THE INVENTION

The present invention is in the field of lighting.

DISCUSSION OF RELATED ART

Tube lighting was popularized when fluorescent lighting was at its zenith. Historically, drivers and ballasts were mounted to the lighting fixture for powering tube lighting. Generally, lighting controls have been through the line input rather than embedded on the driver itself.

Inventor Westerveld Johannes Hendrikus describes a lighting system in U.S. Pat. No. 7,513,640B2 entitled the Light Tube System that was published on Apr. 7, 2009. The abstract describes, "A light tube holder includes two internal sockets, an external socket and a plug. The internal sockets of the light tube holder can receive two pair of pins of a light tube. The external socket of the light tube holder can receive the plug of another light tube holder so that the light tube holders are connected to each other."

Inventor Stanley Mayer describes a lighting system in U.S. Pat. No. 8,313,212B1 Modular Lighting System And Method that was published on Nov. 20, 2012. The abstract describes, "A modular lighting system has first, second and third lighting fixtures adapted for end-to-end electrical interconnection. The lighting fixtures are mounted to a Support structure in a closely abutting relationship with the longitudinal axes thereof in alignment. First and second electrical inter-connector are removably connected to the first and second lighting fixtures and the second and third lighting fixtures, respectively. The first and second electrical interconnectors are connectable and disconnectable from a top of the lighting fixtures without dismounting the lighting fixtures, and the second lighting fixture intermediate the other two lighting fixtures being dismountable from the support structure without dismounting the other two lighting fixture by removing the first and second electrical inter-connectors from the top of the lighting fixtures."

SUMMARY OF THE INVENTION

A parallel connectable light control system has a first driver and a second driver. A dimming control interface in the first driver. The dimming control interface has a sensor side signal and the dimming signal internal output. The dimming signal internal output outputs to a dimming signal external output. The sensor side signal outputs to a sensor side signal output. The second driver receives the dimming signal external output into a dimming control interface of the second driver.

A parallel connectable light control system including a power source, a first driver and a second driver. The first driver is connected to the power source, and the second driver is connected to the first driver. A dimming control interface is in the first driver, and has a sensor side signal and the dimming signal internal output. The dimming signal internal output outputs to a dimming signal external output, and the sensor side signal outputs to a sensor side signal output. The second driver receives the dimming signal external output into a dimming control interface of the second driver. A first plug socket connector connects to the first driver, and a second plug socket connector connects to the second driver.

The first plug socket connector carries the dimming signal, sensor signal and power from the first driver to the second driver. Additional driver modules are configured to be daisychained to the second driver and to each other. The data portion or signal portion of the transfer between the first driver and the second driver is the dimming signal and sensor signal. The additional driver modules are sequentially connected to the second driver by additional plug socket connectors.

A line terminal electrical contact is on an opposite side of a driver housing as a loadout electrical contact. Therefore, only a single carrier line is necessary to plug in to make a connection between a standard plug socket connector for carrying both the data and line voltage, wherein the carrier line has a pair of ends with a first end and a second end, wherein the first end is fitted with a first plug socket connector and wherein the second and is fitted with a second plug socket connector.

Figure 1:
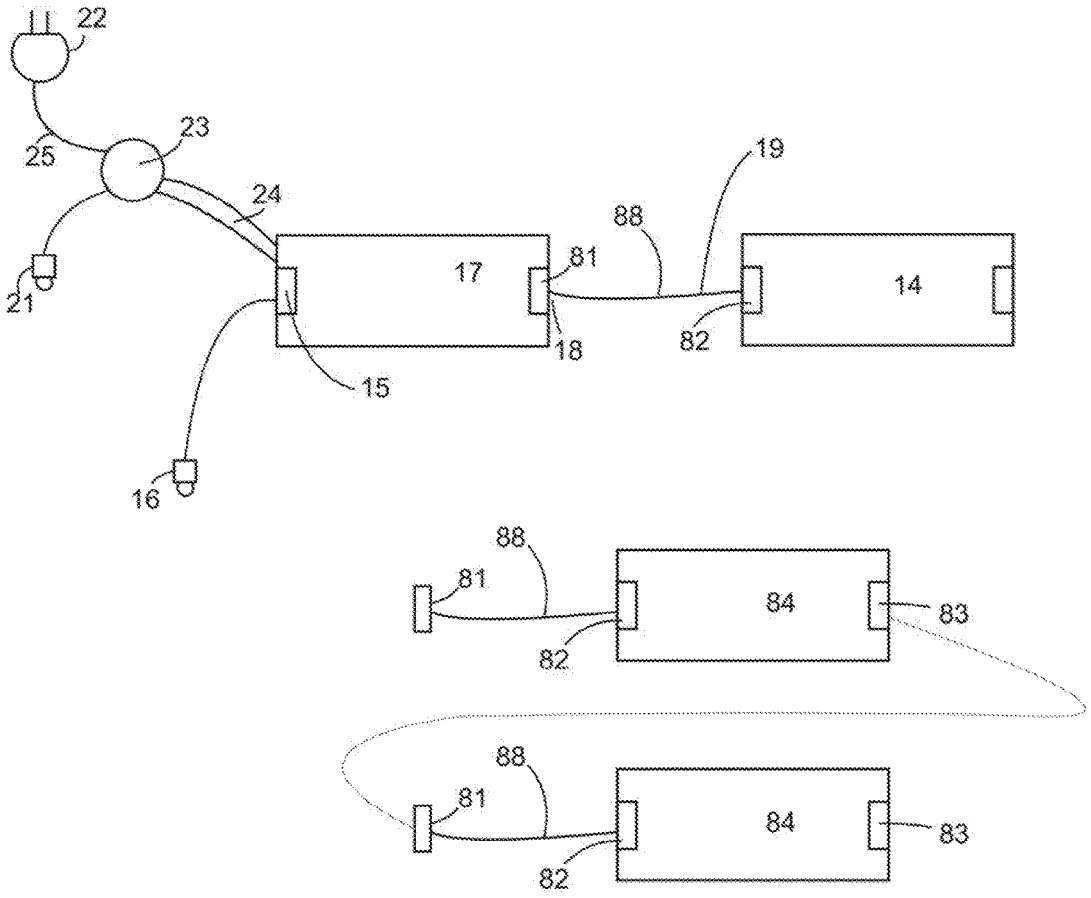
FIG. 1 is a general diagram of the parallel connectable light control system.
Figure 2:
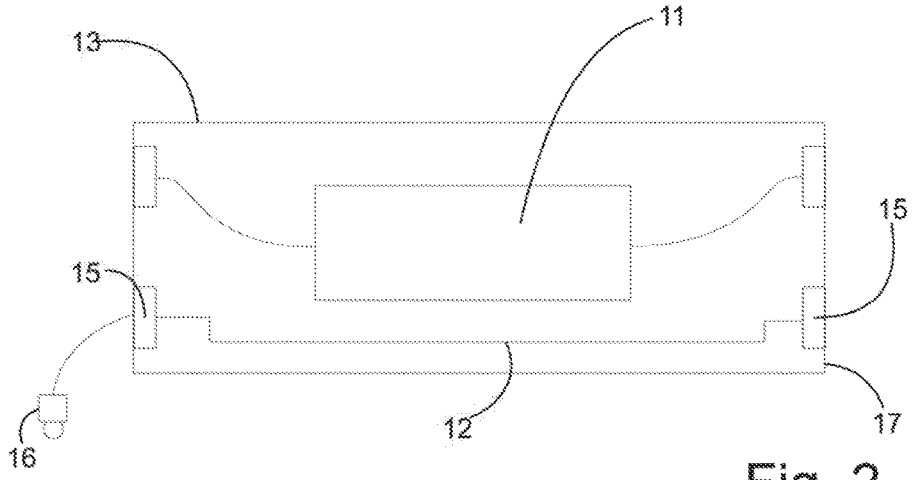
FIG. 2 is a diagram of the first driver which can be similar to a second driver.
Figure 3:
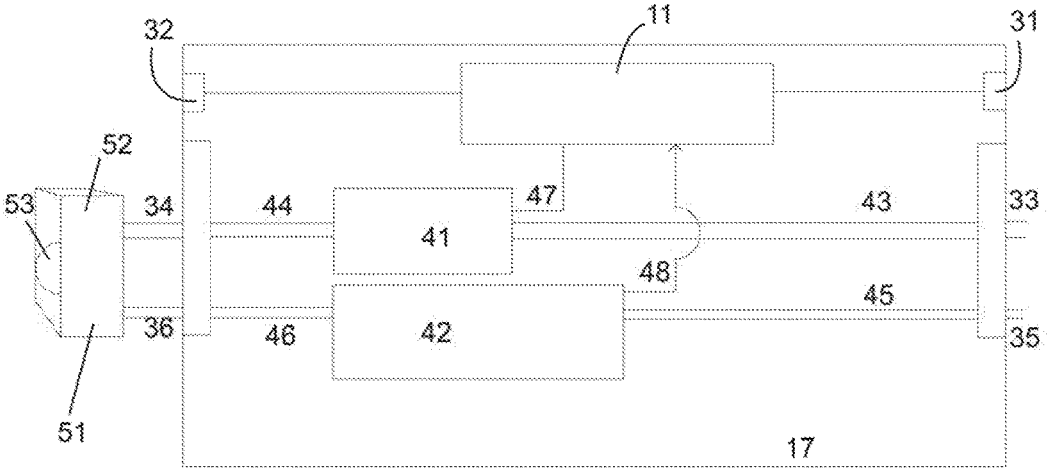
FIG. 3 is a detailed diagram of the first driver with additional optional daisychained drivers.

The following call out list of elements can be as useful guide in referencing the elements of the drawings.

11 Legacy Driver Portion
12 Signal Line
13 Housing
14 Second Driver
15 Connector
16 Sensor Or Transceiver
17 First Driver
18 Standard Plug Socket
19 Direct Signal
21 Legacy Sensor
22 Plug
23 Legacy Control
24 Line Input
25 Plug Cord
31 Load Out
32 Line Terminal
33 Dimming Power Output
34 Sensor Side Dimming Power Output
35 Dimming Signal External Output
36 Sensor Side Signal Output
41 Auxiliary Power Supply
42 Dimming Control Interface
43 Auxiliary Power Internal Output
44 Auxiliary Sensor Power Output
45 Dimming Signal Internal Output
46 Sensor Side Signal
47 Auxiliary Power Supply Input Power
48 Dimming Control To Driver Circuit Signal
51 Microcontroller Or Microprocessor
52 Sensor Housing
53 Sensor
81 First Plug Socket Connector

82 Second Plug Socket Connector
83 Additional Plug Socket Connector
84 Additional Driver Module
88 Carrier Line

DETAILED DESCRIPTION OF THE PREFERRED EMBODIMENT

As seen in the first figure, a parallel connectable light control system has a first driver 17 connected to a second driver 14. The first driver 17 is connected to the second driver 14 by a direct signal 19 which can be carried on a standard plug socket connector 18. A connector 15 can receive a sensor or transceiver 16. The sensor or transceiver 16 can send a signal to the first driver 17 for controlling dimming. The dimming control can be passed along the direct signal 19 from a first driver 17 to a second driver 14. Analogously, a third driver can be connected to the second driver 14 in a parallel connectable system so that a large number of drivers can be daisychained to the first driver on the second driver.

The first driver 17 has a line input 24 that receives a voltage from a legacy control 23. A legacy sensor 21 can be attached to the legacy control 23. The legacy control 23 can receive a plug cord 25 having a plug 22 that connects to household line voltage.

The first driver 17 also has a legacy driver portion 11 which can be standard. The first driver 17 has a housing 13. The housing 13 has a connector 15 to allow plugging of a sensor or transceiver 16 to the connector 15. The connector 15 has a signal line 12 that passes the signal from one side of the driver housing to the other side of the driver housing.

The driver circuit 11 of the first driver 17 receives power from a line terminal 32 formed on a side wall of the housing of the first driver 17. The driver circuit 11 outputs power to a load out terminal 31 also mounted on a side wall of the housing of the first driver 17. The line terminal 32 and the loadout terminal 31 can both be electrical connectors such as standard electrical connectors used for transmission of power.

An auxiliary power supply 41 receives power from the driver circuit 11 via an auxiliary power supply input power 47. The auxiliary power supply 41 outputs an auxiliary sensor power output 44 that is connected to the connector 15. The auxiliary sensor power output 44 becomes the sensor side dimming power output 34 which powers the microprocessor or microcontroller 51 in the sensor housing 52. The sensor 53 can be a lighting sensor or infrared sensor that receives an infrared beam signal such as an infrared beam signal from a remote control. The sensor 53 is read by the microcontroller or processor 51 and then generates a sensor side signal output 36. The sensor side signal output is received by the connector 15 and then becomes the sensor side signal 46. The sensor side signal 46 is electrically connected to the dimming control interface 42. The dimming control interface 42 outputs a dimming control to driver circuit signal 48 so that the driver circuit 11 can be controlled by the dimming control interface 42. Simultaneously, the dimming control interface 42 outputs a dimming signal internal output 45 which connects to the connector 15 and then outputs a dimming signal external output 35. The dimming signal external output 35 of the first driver 17 can be connected to a connector 15 of a second driver 14 so that a single dimming signal can control multiple drivers.

The standard plug socket connector 18 can carry the direct signal 19 from the first driver 17 to the second driver 14. The standard plug socket connector 18 can also carry electrical power. In this way, the drivers can be daisychained to each other through the standard plug socket connector 18. The installer only needs to plug in a carrier line 88 to make the connection. The carrier line 88 has a standard plug socket connector 18 for carrying the data and power. The carrier line 88 may have more than one standard plug socket connector. The carrier line 88 could have a first plug socket connector 81 and a second plug socket connector 82. Additional driver modules 84 can be sequentially added to the previous driver modules as needed. The additional driver modules have additional plug socket connectors 83.

The additional plug socket connector lines include a first plug socket connector 81, and a second plug socket connector 82. As before, the first plug socket connector 81 connects to the load out 31, the dimming power output 33 and the dimming signal external output 35. The first plug socket connector 81 passes electrical connectivity to the second plug socket connector 82. Preferably, the line terminal 32 electrical contact is on the opposite side of the driver housing as the loadout 31 electrical contact.

The key feature of the resin invention is that the daisychained system passes all of the essential power and data electrical conductivity through a single line which minimizes installation line length. This allows quick installation and easy expandability.

The invention claimed is:

1. A parallel connectable light control system comprising:
a power source;
a first driver and a second driver, wherein the first driver is connected to the power source, and wherein the second driver is connected to the first driver;
a dimming control interface in the first driver, wherein the dimming control interface has a sensor side signal and the dimming signal internal output, wherein the dimming signal internal output outputs to a dimming signal external output, wherein the sensor side signal outputs to a sensor side signal output, wherein the second driver receives the dimming signal external output into a dimming control interface of the second driver; and
a first plug socket connector that connects to the first driver, and wherein a second plug socket connector connects to the second driver.

2. The parallel connectable light control system of claim 1, wherein a first plug socket connector carries the dimming signal, sensor signal and power from the first driver to the second driver.

3. The parallel connectable light control system of claim 1, wherein additional driver modules are configured to be daisychained to the second driver and to each other.

4. The parallel connectable light control system of claim 1, wherein additional driver modules are sequentially connected to the second driver by additional plug socket connectors.

5. The parallel connectable light control system of claim 1, wherein a line terminal electrical contact is on an opposite side of a driver housing as a loadout electrical contact.

6. The parallel connectable light control system of claim 1, wherein only a single carrier line is necessary to plug in to make a connection between a standard plug socket connector for carrying both the data and line voltage, wherein the carrier line has a pair of ends with a first end and a second end, wherein the first end is fitted with a first plug socket connector and wherein the second and is fitted with a second plug socket connector.

7. The parallel connectable light control system of claim 6, wherein a first plug socket connector carries the dimming signal, sensor signal and power from the first driver to the second driver.

8. The parallel connectable light control system of claim 6, wherein additional driver modules are configured to be daisychained to the second driver and to each other.

9. The parallel connectable light control system of claim 6, wherein additional driver modules are sequentially connected to the second driver by additional plug socket connectors.

10. The parallel connectable light control system of claim 6, wherein a line terminal electrical contact is on an opposite side of a driver housing as a loadout electrical contact.

* * * * *